United States Patent [19]

Miller

[11] 3,938,743

[45] Feb. 17, 1976

[54] ADJUSTABLY POSITIONABLE SUPERSONIC NOZZLE MEANS

[75] Inventor: A. Leslie Miller, Pittsburgh, Pa.

[73] Assignee: Koppers Company, Inc., Pittsburgh, Pa.

[22] Filed: June 26, 1974

[21] Appl. No.: 483,236

[52] U.S. Cl. ..... 239/457; 239/582

[51] Int. Cl.[2] ..... B05B 1/32; B05B 1/30

[58] Field of Search ..... 239/600, 581, 582, 101, 239/102, 271, 276, 289, DIG. 13; 266/34 L

[56] References Cited

UNITED STATES PATENTS

| | | | |
|---|---|---|---|
| 1,779,009 | 10/1930 | Negro | 239/457 |
| 2,514,506 | 7/1950 | Mueller | 239/582 |
| 3,326,467 | 6/1967 | Fortman | 239/102 |
| 3,337,135 | 8/1967 | Blakely et al. | 239/102 |
| 3,583,633 | 6/1971 | Camparque | 239/102 |
| 3,652,017 | 3/1972 | Nielsen | 239/582 |

*Primary Examiner*—Lloyd L. King
*Attorney, Agent, or Firm*—Robert D. Yeager

[57] ABSTRACT

Nozzle means are disclosed that are particularly suited for use in combination with tuyeres of metallurgical reducing or refining vessels. The nozzle means is axially positionable within the tuyere to maintain a supersonic jet as the tuyere is consumed. Both axially divergent-convergent and convergent-divergent nozzle means are disclosed. Also disclosed is a combination of nozzle means to effect rapid shut-off of the tuyere by positioning a conforming convergent first portion into the convergent second portion of the nozzle means.

1 Claim, 3 Drawing Figures

ADJUSTABLY POSITIONABLE SUPERSONIC NOZZLE MEANS

FIELD OF THE INVENTION

The present invention relates to an adjustable nozzle device for providing a supersonic velocity in a tube, and, in particular, to an adjustably positionable supersonic nozzle for use with a tuyere in a metallurgical vessel.

BACKGROUND OF THE INVENTION

It is generally well known that combustible material introduced through a tuyere into a reducing furnace requires proper atomization and mixing. By utilization of a supersonic nozzle wherein a shock wave is produced in the divergent portion, atomization and mixing are optimized. Typically, however, the construction of such nozzles has been with relatively limited parameters precluding any useful variation in the flow rates of the combustible material.

Recently, a method and apparatus have been proposed for the operation and construction of a tuyere in which relatively wide variations in the flow rate of combustible material is permitted while at the same time forming the necessary shock wave in the divergent portion of the nozzle for proper atomization. See U.S. Pat. No. 3,771,473, where the convergent portion of the supersonic nozzle is modifiable by axially adjusting a central body portion arranged substantially coaxially in the convergent portion.

The device shown in U.S. Pat. No. 3,771,473 is useful in applications such as a blast furnace; it has limited application, however, in tuyeres for refining vessels, in particular, submerged blowing steelmaking vessels. In a submerged blowing steelmaking vessel, a common problem is that the velocity of the exiting gas, such as oxygen, from the tuyere is not sufficient to prevent the erosion of the refractory material. It is, therefore, desirable to produce a tuyere structure in which the gas blown into the hot metal exits therefrom at a supersonic velocity. However, since the tuyeres in a submerged-blown vessel are consumed together with the refractory material, prior art tuyere nozzles which provide a supersonic flow are consumed well before the end of the useful life of the tuyere. Furthermore, in some applications it is desirable to introduce into the tuyere a combustible material which must be properly atomized for supersonic injection into the hot metal. Moreover, while it is necessary to provide supersonic velocities of the fluid blown into the metallurgical vessel, it is frequently required that velocities less than supersonic be provided or be possible.

Accordingly, it is an object of the present invention to provide a nozzle means capable of producing a supersonic jet of gas at the end of an erodible tuyere. It is another object of the invention to provide a nozzle means which is capable of providing an optimized supersonic velocity that is selectively reducible by adjusting the position of the nozzle means. It is a further object of the present invention to provide a nozzle means wherein a combustible material may be properly atomized at varying flow rates while maintaining supersonic injection at the output end of a constantly erodible tuyere.

SUMMARY OF THE INVENTION

The nozzle means of the present invention comprises a venturi member axially aligned within a tubular member such as a tuyere for creating a supersonic velocity in a gas flowing therethrough. The venturi member includes an axially converging portion, a constricted neck portion in communication with the convergent portion and a divergent portion in communication with the neck portion. The venturi member is rigidly secured to an adjusting means for slidable engagement within the tubular member. By proper adjustment of the adjusting means, the venturi member can be axially positioned at any point along the tubular member including a position wherein the divergent portion thereof protrudes beyond the end, for example in a tuyere into the metal bath. Thus, the nozzle means provides a supersonic velocity in a gaseous fluid that is capable of maintaining the jet by retracting the venturi member as the exposed end of the tuyere is consumed.

In another embodiment of the present invention, the nozzle means comprises a central member axially positioned within a tubular member such as a tuyere. The central member includes a diverging portion terminating at an annular portion of constant diameter, the outer surface of which cooperates with the inner surface of the tuyere to form a constricted annular passageway. A converging portion is positioned at the injection end of the nozzle means. The central member is rigidly secured to an adjusting means to position the nozzle member along the axis of the tubular member.

In a further embodiment of the invention, a combination nozzle means is provided including an axially aligned venturi member having a converging portion, a restricted neck portion and a divergent portion at the injection end of the nozzle. The venturi member is rigidly secured to an adjusting means for adjustably positioning the venturi member with a tuyere or like tubular structure. In combination with the venturi member is a central member having a divergent portion, an annular portion restricting the flow peripherally therearound and a convergent portion axially aligned with the convergent portion of the venturi member. Preferably, the convergent portion of the central member has a conical half angle equal to the conical half angle of the convergent portion of the venturi member. The central member is secured to the adjusting means of the venturi member for movement therewith, and to second adjusting means for independent adjustment with respect to the venturi member. By relatively positioning the central member with respect to the venturi member, various gas flow rates can be accommodated through the tuyere to provide proper atomization by producing a shock wave in the divergent portion of the venturi member. Additionally, the convergent portion of the central member is adapted to conformingly engage the convergent portion of the venturi member to provide a rapid shut-off of the tuyere.

Other advantages of the present invention will become apparent from a perusal of the following detailed description of the presently preferred embodiments taken in conjunction with the accompanying drawings.

PRESENTLY PREFERRED EMBODIMENTS

Figure 1:
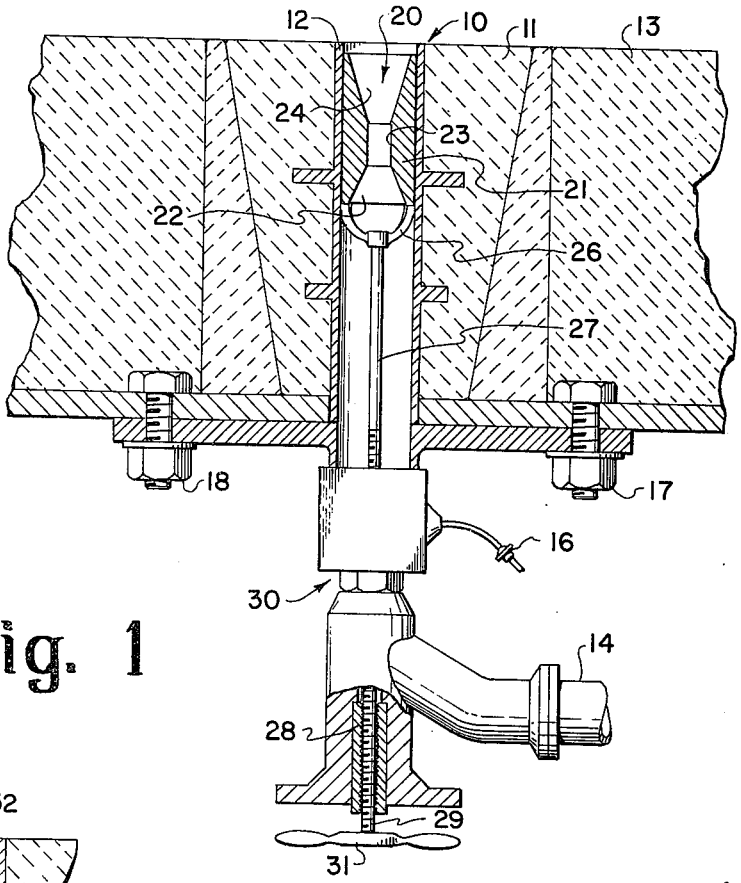
FIG. 1 is a sectional elevation of a nozzle means comprising a venturi member rigidly secured to an adjusting means.

With reference to FIG. 1, a tuyere 10 comprising a refractory plug 11 and metal tubular member 12 imbedded therein is mounted in refractory material 13 of a metallurgical vessel, such as a steelmaking refining vessel. Tuyere 10 is operably connected to a source of oxygen 14 and, optionally, to a source of combustible material 16. Tuyere 10 may also comprise a concentric double tuyere where tubular member 12 comprises the inner axial tuyere which is spaced apart from an outer concentric tuyere, not shown. In this operation, line 16 may be connected to a source of protective fluid that is injected peripherally of the oxidizing gas injected through tubular member 12.

Nozzle means 20 comprises a venturi member 21 having an axially converging portion 22 in communication with oxygen flowing through tuyere tube 12 from source 14. Converging portion 22 terminates into a restricted neck portion 23 which discharges into divergent portion 24. Rigidly mounted to venturi member 21 at the converging portion 22 is positioning spider 26. Connected to the center of spider 26 is shaft 27 which extends the length of the tuyere tube 12 and through mounting block 28 at the end of oxygen manifold 30 which is secured to the vessel by securing bolts 17 and 18. Mounting block 28 is fixedly mounted at the bottom of manifold 30 and includes a machine-threadable engagement with shaft 27 for sealing the oxygen within the manifold. Threaded end portion 29 of shaft 27 extends through securing member 28 and includes thereon handle 31.

By rotation of handle 31, threaded portion 29 of shaft 27 is adjustably positioned within securing member 28 to slidably engage venturi member 21 within tube 12.

Preferably, venturi member 21 is fabricated from a high conductivity copper or a ceramic material. The outer diameter of venturi member 21 is preferably of a size sufficient to insure slidable frictional engagement within tuyere tube 12. Where diverging portion 24 is designed to be selectively positioned to protrude beyond the end of tuyere 10 into a hot metal bath, it is preferred that a high temperature ceramic be utilized in the fabrication of venturi member 21.

Venturi member 21, in particular, portions 22, 23 and 24 are designed for a particular velocity, e.g. Mach 2, utilizing well known nozzle design parameters. While in operation, velocities greater than the optimum design velocity cannot be obtained, velocities less than the design velocity can be achieved at the end of the tubular member by axially positioning the divergent portion away from the discharge end of said member. Preferably, a substantially linear relationship is provided.

Figure 2:
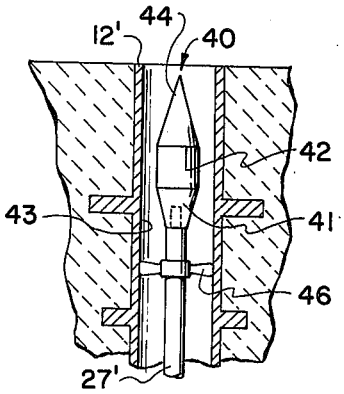
FIG. 2 is a sectional elevation of a portion of a nozzle means comprising a central member adapted for adjustable engagement within a tuyere.

With reference to FIG. 2, nozzle means 40 is axially positioned within tuyere tube 12′ to produce a supersonic jet of oxygen and/or combustible material. Nozzle means 40 includes a central member having an axially divergent portion 41 which diverges into annular or neck portion 42. Annular portion 42 provides a constricted annular passage 43 in cooperation with the inner surfaces of tuyere tube 12′. A convergent portion 44 is provided at the discharge or injection end of nozzle 40. Shaft 27′ is mounted to divergent portion 41 of nozzle 40 and includes a centering spider 46 for axially aligning shaft 27′ and nozzle 40 within tuyere tube 12′. Shaft 27′ is operably connected to an adjusting means, not shown, similar to that referred to and described with reference to FIG. 1.

To obtain supersonic velocities with nozzle means 40, it is necessary to position the end of convergent portion 44 beyond the discharge periphery of tubular member 12′ to provide a reduced flow area as contrasted with flow area of the reservoir side of the nozzle ahead of divergent portion 41. Thus, the angle of convergent portion 44, its length and relationship to the diameter of tubular member 12′ are designed to obtain the optimum velocities required for its ultimate end use.

Figure 3:
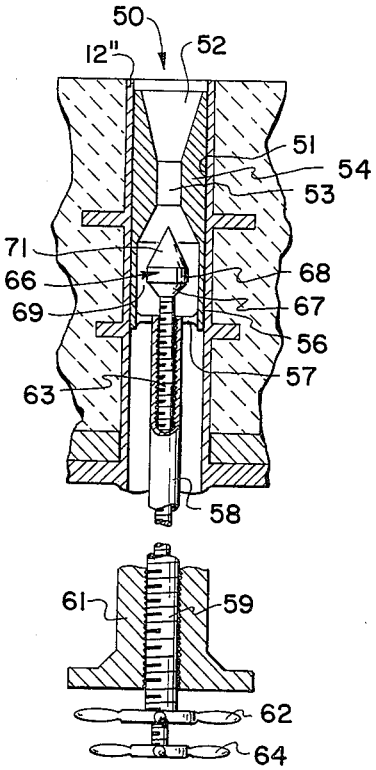
FIG. 3 is a sectional elevation of a combination nozzle means comprising a venturi member and a central member and adjusting means for adjusting the relative position of said members.

Referring to FIG. 3, a combination nozzle means 50 is shown mounted for sliding engagement within tuyere tube 12″. Nozzle means 50 comprises a venturi member 51 having an axial divergent portion 52 for discharging a supersonic jet of gas. Venturi member 51 also includes a neck portion 53 in communication with divergent portion 52 and convergent portion 54. Mounted to convergent portion 54 of venturi member 51 is cylindrical extension 56 having inwardly projecting therefrom a plurality of radial securing arms 57. The outer surface of extension 56 is adapted to frictionally engage the inner surface of tube 12″.

Mounted to the center of radial securing arms 57 is internally threaded annular shaft 58. Shaft 58 includes an externally machine threaded end portion 59 adapted to threadably engage and extend through securing member 61. Securing member 61 is rigidly mounted to the bottom of an oxygen manifold, not shown. Mounted to the end of shaft 58 at end portion 59 is handle 62 for rotation of shaft 58 within securing member 61. Threadably engaged within shaft 58 is second shaft 63 having external threads engageable with the internal threads of shaft 58. Shaft 63 extends through shaft 58 and at its lower portion includes a handle 64.

Mounted to the other end of shaft 63 is central member 66. Central member 66 includes an axial divergent portion 67 diverging to a neck portion 68 which in cooperation with cylindrical member 56 provides an annular passage 69. Neck 68 terminates into convergent portion 71 having a conical half angle of converging portion 54 of venturi member 51.

By means of rotation of handle 62, nozzle means 50 is axially positionable along tuyere tube 12″. By rotation of handle 64, central member 66 may be independently positioned with respect to venturi member 51. By means of the relative positioning of central member 66 with respect to venturi member 51, various gas flow rates can be accommodated while maintaining a shock wave in divergent portion 52 for atomization of a combustible material if desired. Optionally, convergent portion 71 of central member 66 can be positioned within convergent portion 54 of venturi member 51 to effect a rapid and complete shut-off of the gas flowing through tuyere 12″. Once the relative positions of venturi and central members have been established, the relationship is maintained as nozzle means 50 is axially positioned along tuyere 12″.

While manual adjusting means have been shown, it is clear that automatic adjusting means may be utilized. Thus, instead of the various handles used to rotate the associated shafts, electro-mechanical, hydraulic or like drive means may be used. Preferably, the drive means are operably connected to a control means which automatically compensates for erosion of the tuyere. Thus, while variously preferred embodiments of the invention have been shown and described in particularity, it may be otherwise embodied within the scope of the appended claims.

What is claimed is:

1. Apparatus for use in a tuyere or like tubular member to impart supersonic velocity to a fluid passing therethrough, said apparatus comprising:

nozzle means including a central member axially positionable within a tubular member, said central member having a convergent portion, a divergent portion, and a neck portion between said divergent and convergent portions to define an annular passageway between said neck portion and tubular member having a restricted flow area to said fluid;

a venturi member having an axially convergent portion, an axially divergent portion, and a neck portion positioned between said convergent and divergent portions of said venturi member; said central member having its convergent portion of a shape substantially conforming to the convergent portion of said venturi member and being axially positionable with respect to said convergent portion of said venturi member;

a first adjusting means operably connected to said venturi member and central member for axially positioning said members along said tubular member; and a second adjusting means operably connected to said central member for positioning said central member relative to said venturi member.

* * * * *